US006804841B1

(12) United States Patent
Williams

(10) Patent No.: US 6,804,841 B1
(45) Date of Patent: Oct. 19, 2004

(54) ARRAY OF WATER JETS FOR IN-GROUND SPAS

(76) Inventor: Jack Williams, 3218 E. Pima St., Tucson, AZ (US) 85716

( * ) Notice: Subject to any disclaimer, the term of this patent is extended or adjusted under 35 U.S.C. 154(b) by 0 days.

(21) Appl. No.: 10/404,391

(22) Filed: Apr. 1, 2003

(51) Int. Cl.[7] ..... A47K 3/00; E04H 4/00
(52) U.S. Cl. ..... 4/541.1; 4/492
(58) Field of Search ..... 4/492, 496, 508, 4/541.1–541.6

(56) References Cited

U.S. PATENT DOCUMENTS 5,083,329 A * 1/1992 Murakami ..... 4/541.4
5,156,642 A 10/1992 Lopez
5,754,989 A 5/1998 Ludlow
5,809,648 A 9/1998 Kurth et al.
5,896,597 A 4/1999 Kurth et al.
5,987,663 A 11/1999 Ludlow et al.
6,092,246 A 7/2000 Ludlow
6,233,754 B1 * 5/2001 Ajima ..... 4/488
6,256,805 B1 7/2001 Ludlow et al.

* cited by examiner

*Primary Examiner*—Charles E. Phillips
(74) *Attorney, Agent, or Firm*—Gavin J. Milczarek-Desai; Quarles & Brady Streich Lang, LLP

(57) ABSTRACT

An array of water jets that does not utilize hoses between the water supply inlet and each individual jet and provides a multiple-jet experience for in-ground spa users. The array of jets include a water-containing structure having at least a front and back panel that define an interior cavity into which water flows and becomes pressurized. The front panel has a plurality of water outlets disposed thereon while, preferably, the back panel has a water or a water and air inlets. Accordingly, water (and air) flow hoselessly from the inlet (s) to the plurality of water outlets such that a water-jet effect is achieved.

11 Claims, 4 Drawing Sheets

ARRAY OF WATER JETS FOR IN-GROUND SPAS

BACKGROUND OF THE INVENTION

1. Field of the Invention

This invention relates generally to water jets for spas and the like and more particularly to apparatuses that house a plurality of water jets for installation in cementitious (in-ground) spas.

2. Description of the Related Art

Recreational bathing units, such as spas, "hot tubs," whirlpools, and the like, have become increasingly popular in recent years. Most recreational bathing units are constructed as "above-ground" (as opposed to "in-ground") models and typically include a molded shell that serves to contain water, with seats, shelves and other features molded into the shape of the shell. The shell is usually made from plastic, fiberglass, or a composite material. One or more pumps housed under the shell draw water contained in the shell and re-circulate it through a variety of "pressure nozzles," e.g., so-called hydrotherapy or water jets.

The water jets are usually mounted in the shell under the water line, and are designed to provide a comforting or therapeutic effect to a person in the spa One typically installs a water jet in an above-ground spa by making a hole in the shell, and fixing the jet in the hole by a use of seals, adhesives, welding compounds, etc. Water supply lines from the pumps to the jets are usually flexible hose connections or rigid PVC piping. After the jets and tubing are in place, a foam-like material is blown into the empty spaces to provide thermal and sound insulation. This general construction method has been utilized very successfully, and is currently almost universally used in the above-ground spa industry.

As the demand for spas has increased, so too has the demand for more features. Indeed, one of the most popular options presently is the multiple-jet bank or array. An array of jets is a single structure that houses a plurality of water jets such that the jets are concentrated in a particular area of the spa, thus increasing the level of comfort or therapeutic massage felt by the spa user. For example, in U.S. Pat. No. 6,092,246, Ludlow describes and illustrates a removable panel of jets plumbed from a single water and air inlet. Like the other jets found in above-ground spas, Ludlow's array of water jets contains hoses that carries the water from the inlet pipe, through the array interior and to the jets.

While multiple water jets are commonly featured in higher end above-ground spas, up until now (and for a variety of cost and construction-related reasons as discussed below), in-ground spas are only plumbed with single water jets. This is because the water and air supply pipes of in-ground spas extend into the ground and through concrete reinforcing bar ( "rebar") and cementitious material (e.g., gunite), making the plumbing of multiple pipes for multiple water jets very labor intensive (see FIGS. 1 and 2). Moreover, a high degree of precision and coordination between the cement and steel contractors and the plumber is required if water jet location and alignment are to be satisfactory after the cement is poured. Obviously, plumbing or jet installation mistakes are difficult and expensive to fix once the in-ground spa hardens.

Simply adding an array of jets designed for use in an above-ground spa (such as Ludlow's) would not provide a good solution due to the complexity of installation of Ludlow's hollow pod structure. Furthermore, poor workmanship and defects in the hose materials that link each jet to the water supply line can cause leaks. In fact, even ordinary wear and tear tends to flex hosing joints and seals and eventually open them up to form leaks. Therefore, the more tubing or piping utilized in an array of jets, the higher the probability over time of a leak occurring.

The amount of horsepower that water and air pumps can supply to an above-ground spa versus an in-ground spa is generally much less. This difference limits the number and type of water jet arrays that can usefully be installed in an above-ground spa. For example, the jet arrays installed in many above-ground spas feature "mini-jets" due to the fact that the piping must be small enough to supply sufficient water velocity. In-ground spas typically do not have such constraints because the pumps utilized therewith are not housed within a spa shell and can therefore be much larger and more powerful. This also means that the water jet array and any piping it contains must be able to withstand the higher water pressure produced by a relatively high horse power in-ground spa pump.

For the foregoing reasons, neither the Ludlow patent nor any other reference is known to disclose or suggest the installation of above-ground "jet pods" or jet arrays in a cementitious (in-ground) spa Thus, there remains a need in the art for an array of water jets that is adapted specifically for in-ground spa use, is inexpensive to manufacture, easy to install, and is less prone to leakage due to a structure that obviates the need for hose connections between the jets and the water supply.

SUMMARY OF THE INVENTION

The invention relates in general to an array of water jets that does not utilize hoses between the water supply inlet pipe and each individual jet, making it especially suitable for in-ground spa use. More particularly, the invention relates to a water-containing structure having a front and a back panel, thus defining an interior cavity through which water flows to the in-ground spa The front panel has a plurality of water outlets disposed thereon while, preferably, the back panel has a water or a water and air inlets. A venturi also may be included where the water and air pipes interface such that aeration of the water occurs. Accordingly, water (and air) flow hoselessly from the inlet(s) to the plurality of water outlets such that a water-jet effect is achieved. Of course, each water outlet may be provided with a variety of pressure nozzles or jet fittings.

Thus, the present invention provides significant advancement over the known related art by providing an array of water jets that uses no hoses within the internal cavity of the water-containing structure to connect the water supply to the water outlets. This is an improvement over the existing art because there are no hoses or hose fittings within the array to break or leak. Moreover, the invention is simple to install on a single water supply pipe and can be either inset into the spa wall or connected to the spa wall surface.

In one embodiment, the water-jet array of the invention is substantially rectangular in cross-section, having a front panel and a back panel connected by four sidewalls, and can be installed such that the front panel is flush with the spa-wall interior surface. In another embodiment, the array features a front panel that is concave and is thus suitable for mounting on a water supply pipe such the array extends from the spa-wall interior surface to form, for example, a neck or back massage station. Still another embodiment features a front or back panel that is convex. Practically any size array or number of arrays or jets can be accommodated provided the water pump is sufficient to supply the desired water pressure.

Therefore, it is a primary objective of the invention to provide a water-jet array that requires water to flow hoselessly from a supply inlet to a plurality of water-jet outlets.

Further, an object of the invention is to provide a water-jet array that is installed as a single unit and without additional plumbing.

Another object of the invention is to provide a water-jet array that is easy to install in a spa constructed from cementitious materials.

Still another object of the invention is to provide a water-jet array that is inexpensive to manufacture.

Yet another object of the invention is to provide a water-jet array that minimizes the possibility of leakage and related repair expense.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

The invention generally relates to a an array of water jets that is specially designed for in-ground spas in that it does not utilize hoses between the water supply and each individual jet. More particularly, the invention includes a water-containing structure having at least a front and a back panel, preferably front and back panels joined by four side walls. The front panel has a plurality of water outlets, which provide openings in which water flows though a jet fitting attached to the outlet (or may simply gush if no jet fitting is in place). Preferably, the back panel has a water inlet or water and air inlets, though these may also be disposed through one or more side walls.

Figure 1:
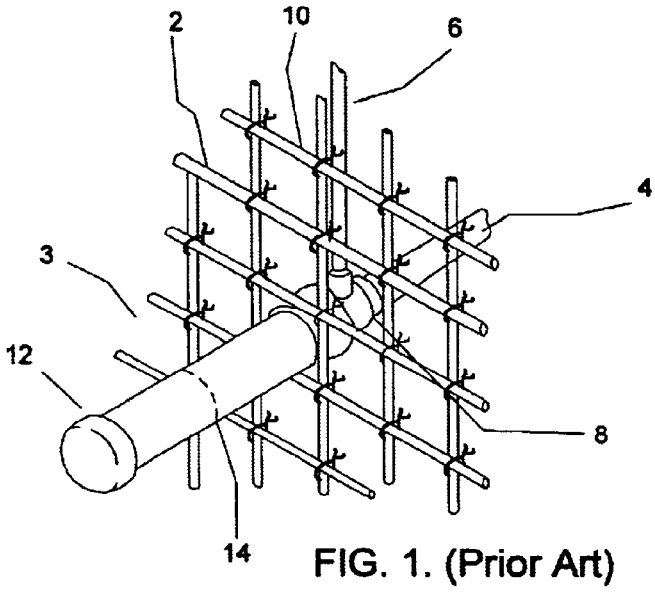
FIG. 1. (Prior Art)
FIG. 1 depicts a perspective view of a prior art plumbing arrangement for a single water jet.
Figure 2:
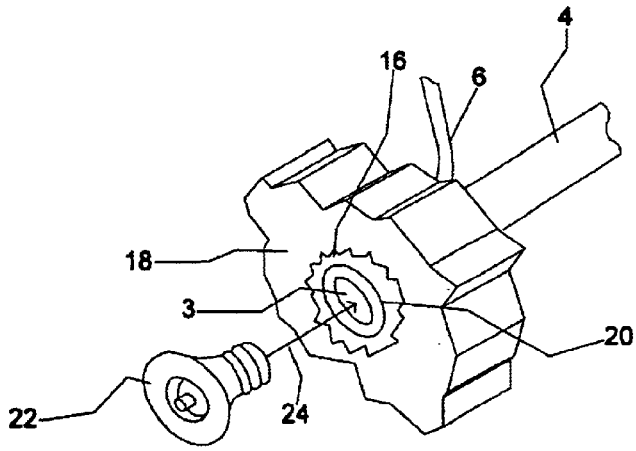
FIG 2. (Prior Art)
FIG. 2 shows an exploded perspective view of a prior art water-jet assembly in relation to the water supply pipe of FIG. 1.

Turning to FIGS. 1 and 2, a depiction of a typical prior art water-jet for in-ground pools is shown. The construction of even a rudimentary in-ground spa involves the use of rebar 2 that is covered by a cementitious material, such as concrete or gunite (not shown). Because of this, a spa contractor typically will install a single water jet in a given location by inserting a water inlet-pipe 3 through the rebar 2. The inlet pipe 3 is then coupled with and sealed to a water supply pipe 4 and an air supply pipe 6 at a joint 8. The assembled components (pipes 3, 4, and 6 and joint 8) are then fastened to the rebar 2 with several ties 10. After the end of pipe 3 is covered by a cap 12 and pressure tested, cementitious material is poured out to dotted line 14, thereby encasing everything except the end of pipe 3.

As shown in FIG. 2, a hole 16 must be chipped in cementitious material 18 to allow the installation of a collar 20 at the end of pipe 3. The collar 20 typically is bonded to the pipe 3, which is then cut so that is will be flush with the surface of cementitious material 18. The collar 20 provides a foundation for further components, such as a retaining ring and a wall fitting (not shown). The hole 16 is then re-plastered and a water jet fitting 22 installed as shown by arrow 24.

Due to this common and labor-intensive method of in-ground spa-jet construction (and the fact that the in-ground spa contractor usually subcontracts work to a separate plumber, steel contractor, and cement contractor), the installation of multiple pipes for multiple jets can become a complicated and ineffective exercise as the subcontractors usually are not precise in their work. Indeed, it is the inventor's experience that the plumber and steel and cement contractors perform their respective tasks at different times and without regard for what the other has done or will need to do. Accordingly, pipes are bent out of position or simply installed at a level or location that does not match the spa owner's expectations. Due to the cost and hassle fixing these errors, single water-jets are the only available option for practically all in-ground spas unless a customer is willing to spend tens-of-thousands of dollars extra to have the spa custom built with each contractor working in coordination with the other.

Figure 3:
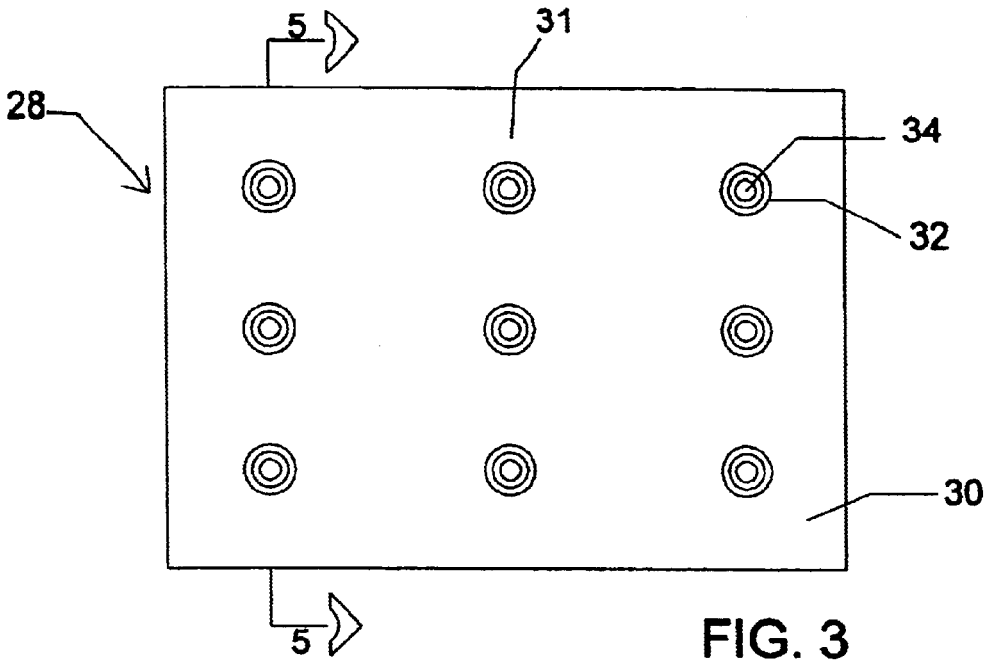
FIG. 3 depicts a front elevational view of a preferred embodiment of the invention.

Turning to FIG. 3, an array of jets 28 according to the invention is shown. As seen in this front elevational view, the array includes a front panel 30 in which a plurality of jets 31 have been disposed. Preferably the front panel 30 has water outlets 32 onto which jet fittings 34 have been placed. The jet fittings 34 may be practically any known in the art, leading to an in-ground spa that can include, for example, adjustable, massaging, and/or hand held jets.

Figure 4:
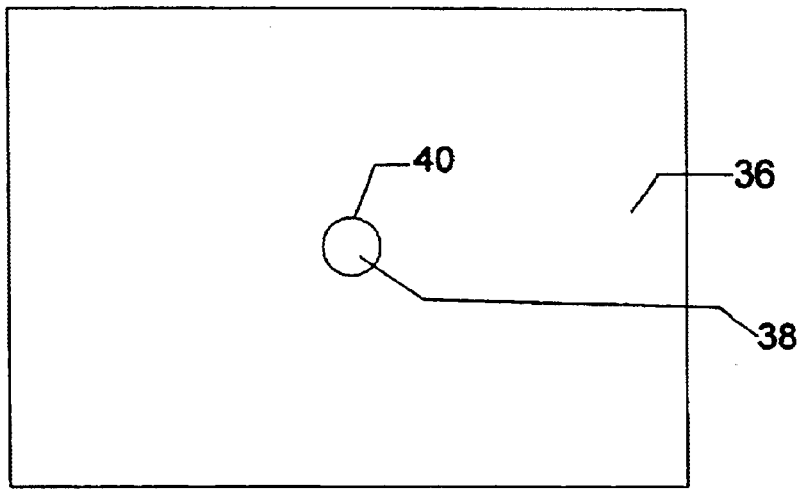
FIG. 4 depicts a rear elevational view of the same embodiment of the invention shown in FIG. 3.

As shown in back elevational view in FIG. 4, the invention further includes a back panel 36. Preferably, the back panel 36 has a water inlet disposed thereon, such as opening 38. However, most preferably, a pipe stub 40 is molded on (or attached) to opening 38 to facilitate the joining of the array 28 to an existing water supply pipe.

Figure 5:
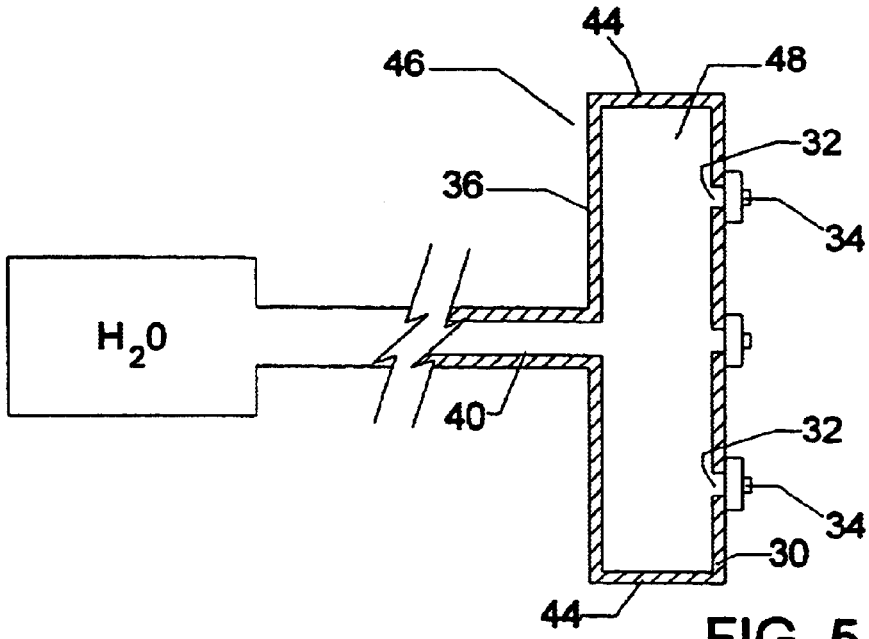
FIG. 5 shows in cross-section a view taken along line 5—5 of the embodiment illustrated in FIG. 3.

Turning to FIG. 5, a cross-sectional view of the embodiment of FIG. 3 taken along line 5—5 is shown. The front panel 30, back panel 36, and four side walls 44 (two of which are visible in this view) form a water-containing structure 46 that defines an interior cavity 48. Thus, water flows from a supply source into the cavity 48 through an inlet (in this case, pipe 40), becomes pressurized within the cavity 48, and is ejected through the jet fittings 34 of water outlets 32.

Figure 6:
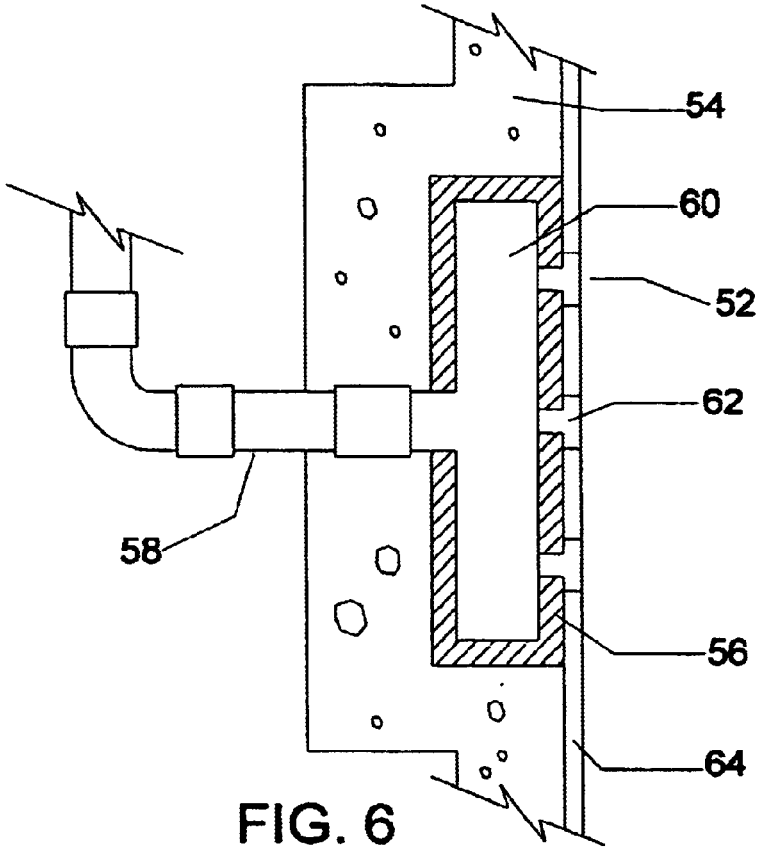
FIG. 6 depicts a cut-away view of a cementitious spa-wall to reveal a side elevational view of a second embodiment of the invention as it appears installed.

A partially cut-away section of an in-ground spa is shown in FIG. 6. Here, an array of jets 52 has been sealed into a gunite spa wall 54 with a "brown-in mixture" (i.e. a concrete fill) 56. A two-inch water and air inlet pipe 58 produces flow into the water-containing structure 60 and out through water outlets 62, which protrude slightly from the spa interior finish 64. Although not illustrated herein, it would be understood by one skilled in the art that the water-containing structure of the invention may be fashioned in various ways without departure from the invention. For example, while the water-containing structure 60 may be formed as a single piece, it is preferably formed from two halves that are joined by a PVC weld, can be molded into different shapes, and can contain water outlets of various sizes or shapes. Thus, the preferred embodiment should not be construed to limit the invention to the particular structure just described.

Figure 7:
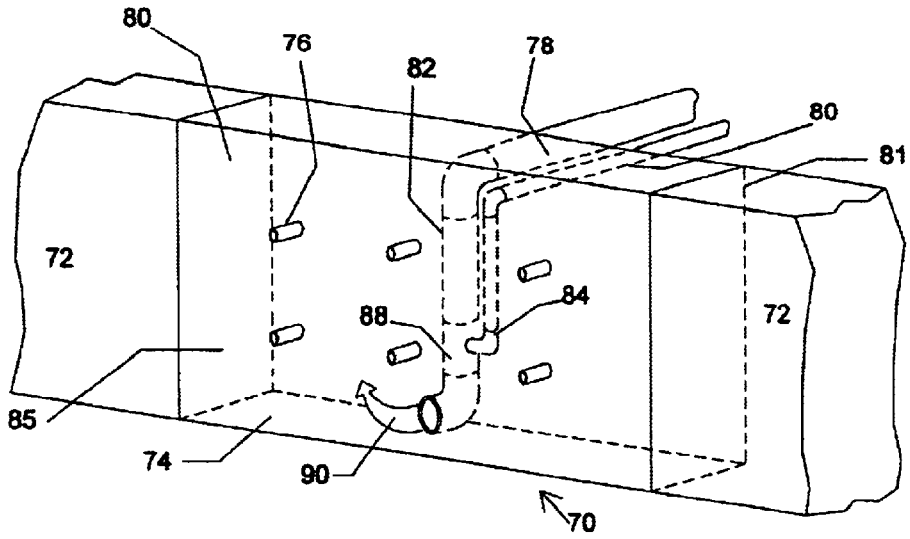
FIG. 7 illustrates a front perspective view of a third embodiment of the invention inset into the wall of an in-ground spa

Turning to FIG. 7, a front perspective view (with back, bottom, and interior components shown in phantom line) of a third embodiment is illustrated. In this embodiment, a water-jet array 70 is installed in a concrete wall 72 of an in-ground spa so that the front panel 74 containing water outlets 76 is flush with the interior of the spa Openings 78 and 80 in the rear panel 81 allow water inlet pipe 82 and air inlet pipe 84 into the interior cavity 85 of water-containing structure 86. Pipes 82 and 84 may merge at a venturi 88, thereby increasing aeration of water 90.

Figure 8:
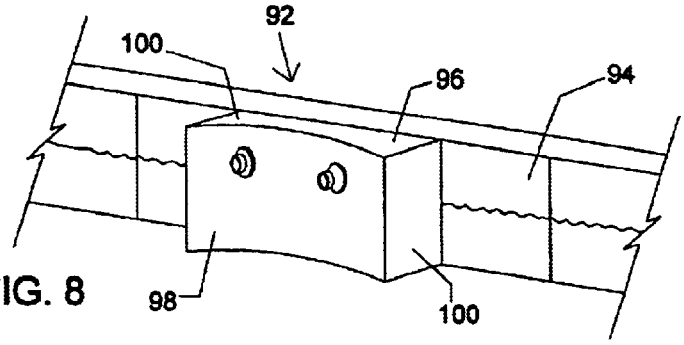
FIG. 8 shows a front perspective view of a fourth embodiment of the invention.

FIG. 8 illustrates a fourth embodiment of the invention in front perspective view. The array of jets 92 is mounted to a water inlet pipe (not show) projecting from the surface of the tiles 94. The water-containing structure 96 includes a convex front panel 98, a back panel (not shown), and four side walls 100 that connect the front and back panels. Two adjustable water jets 102 are mounted on front panel 98. The convex shape and location of the water jets make this particular array ideal for neck and back massage applications.

Figure 9:
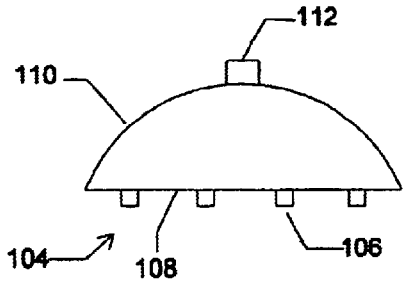
FIG. 9 shows a top plan view of a fifth embodiment of the invention.

Turning to FIG. 9, a plan view of a fifth embodiment of the invention is shown. Here, the array of jets 104 include water outlets 106 disposed upon front panel 108. A convexly shaped back panel 110 is joined to front panel 108, thereby forming an interior cavity (not shown). A water inlet 112 is provided in back panel 110 to receive water for filling the interior cavity.

Given the ease of installation and variety of water-containing structure and jet configurations that may be utilized, it will be readily appreciated that invention can be placed on walls, floors, seats, i.e., practically anywhere in or on the interior of an in-ground spa To give further guidance for the installation of the invention, the following example utilizing the embodiment shown in FIG. 7 is provided. However, the example is only illustrative and is not meant to limit the invention to a specific method of installation.

EXAMPLE

After excavation of the spa, a plumbing line from the water pump or circulation system is stubbed to the location where the array of jets will be installed. Optionally, an air line can also be stubbed to the same location. A STYROFOAM form is then placed over the capped pipe(s) to provide a hollow into which a jet array of the invention is placed after the cementitious materials are poured or sprayed.

Steel reinforcing bars are next added around the perimeter of the spa and at locations where further structural definition will take place (e.g., seats, contours, separation walls, etc.). The cementitious material is then applied to the rebar and around the STYROFOAM form to create the spa structure.

After the cementitious materials have hardened (at the preparation of the spa interior finish phase), the STYROFOAM form is removed and disposed of. The end caps of the water (and air) pipes are removed, and the inlet(s) of the array of jets of the invention are bonded to the existing supply pipe(s). The space around the side walls of the water-containing structure is then browned-in to stabilize the array and to seal out water, thus preventing seepage from the spa in and behind the back panel of the water-containing structure. If desired, the entire jet array (i.e., the front panel) may also be brown-in to the spa wall such that only the water outlets protrude from the wall surface. The interior finish of the spa is then completed, and jet fittings may be added to the water outlets (if not previously installed).

As will now be clear from the description above, the water-jet array of the invention has many advantages over currently existing jets for in-ground spas. Its simple construction and inlet/outlet openings make installation straightforward. Moreover, the lack of hoses (or even pipes in some embodiments) inside the cavity of the water-containing structure minimizes the possibility that leaks and related damage may occur. Furthermore, the "hoseless" design of the invention allows its use with high power water pumps without worrying about wear and tear on hoses or hose joints or seals. Preferably, the water-containing structure of the invention is constructed from acrylic materials. However, any suitably durable and corrosion-resistant material may be utilized. All of these features make the water-jet array of the invention ideal for in-ground spa installation and years of reliable use.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. An array of water jets for in-ground spas, comprising:

a water-containing structure including a front panel and a back panel, said front and back panels being connected to each other by four adjoining side walls;

a water inlet adapted to provide water flow into said water-containing structure; and a plurality of water outlets disposed within said front panel, wherein water flows hopelessly from said water inlet to and out of each of said plurality of water outlets and wherein said water-containing structure further includes an air inlet adapted to provide air flow into said water-containing structure.

2. The water-jet array of claim 1, wherein said water inlet and said air inlet further include a venturi within said water-containing structure.

3. A combination in-ground spa and water jet array, comprising:

an in-ground spa made at least partially from cementitious material;

a water-containing structure including a front panel and a back panel, said front and back panels being connected to each other by four adjoining side panels, wherein said cementitious material contacts at least said back panel of said water-containing structure.

a water inlet adapted to provide water flow into said water-containing structure; and a plurality of water outlets disposed within said front panel, wherein water flows hoselessly from said water inlet to and out of said plurality of water outlets.

4. The combination of claim 3, wherein said plurality of water outlets further include a water-jet fitting disposed thereon.

5. The combination of claim 3, wherein said water-containing structure further includes an air inlet adapted to provide air flow into said water-containing structure.

6. The combination of claim 5, wherein said water inlet and said air inlet further include a venturi within said water-containing structure.

7. The combination of claim 3, wherein said water-containing structure is substantially rectangular in cross-section.

8. The water-jet array of claim 3, wherein said front panel is substantially concave.

9. The combination of claim 3, wherein said cementitious material comprises gunite.

10. The combination of claim 3, wherein said water-containing structure is inset into a wall of said in-ground spa such that said side walls are contacted by said cementitious materials.

11. The combination of claim 3, wherein said water-containing structure defines an interior cavity through which water flows and becomes pressurized, said interior cavity being devoid of any pipes or hosing.

* * * * *

UNITED STATES PATENT AND TRADEMARK OFFICE

CERTIFICATE OF CORRECTION

PATENT NO. : 6,804,841 B1
DATED : October 19, 2004
INVENTOR(S) : Jack Williams

It is certified that error appears in the above-identified patent and that said Letters Patent is hereby corrected as shown below:

Column 6,
Line 47, please change "hopelessly" to -- hoselessly --.

Signed and Sealed this

First Day of February, 2005

JON W. DUDAS
*Director of the United States Patent and Trademark Office*